US012024841B2

(12) United States Patent
Combe et al.

(10) Patent No.: US 12,024,841 B2
(45) Date of Patent: Jul. 2, 2024

(54) DEVICE FOR ABSORBING A LIQUID PRESENT ON A FLOOR IN THE EVENT OF WATER-RELATED DAMAGE OR A FLOOD

(71) Applicants: CERA ENGINEERING, Villars (FR); APROTEK, Saint-Romain-le-Puy (FR)

(72) Inventors: Robert Combe, Sury le Comtal (FR); Stéphane Delheur, Saint Marcellin en Forez (FR)

(73) Assignees: CERA ENGINEERING, Villars (FR); APROTEK, Saint-Romain-le-Puy (FR)

( * ) Notice: Subject to any disclaimer, the term of this patent is extended or adjusted under 35 U.S.C. 154(b) by 229 days.

(21) Appl. No.: 17/598,766

(22) PCT Filed: Mar. 26, 2020

(86) PCT No.: PCT/EP2020/058496
§ 371 (c)(1),
(2) Date: Sep. 27, 2021

(87) PCT Pub. No.: WO2020/193687
PCT Pub. Date: Oct. 1, 2020

(65) Prior Publication Data

US 2022/0195682 A1 Jun. 23, 2022

(30) Foreign Application Priority Data

Mar. 26, 2019 (FR) ..... 1903160

(51) Int. Cl.
*E02B 3/10* (2006.01)

(52) U.S. Cl.
CPC ..... *E02B 3/106* (2013.01)

(58) Field of Classification Search
CPC ..... E02B 3/106; E02B 3/108; E02B 3/126; E02D 31/002; E02D 31/004; E02D 31/006
See application file for complete search history.

(56) References Cited

U.S. PATENT DOCUMENTS 3,186,896 A 6/1965 Clem
4,650,368 A * 3/1987 Bayer ..... E02B 3/127 405/116

(Continued)

FOREIGN PATENT DOCUMENTS

DE 38 02 085 7/1989
EP 0 445 788 9/1991

(Continued)

OTHER PUBLICATIONS

International Search Report for PCT/EP2020/058496 dated May 29, 2020, 7 pages.

(Continued)

*Primary Examiner* — Kyle Armstrong
(74) *Attorney, Agent, or Firm* — NIXON & VANDERHYE

(57) ABSTRACT

The absorption device includes a hydrophilic powder and a casing which is permeable to a liquid, the casing being composed of an upper layer which is superimposed on a lower layer, the lower and upper layers being connected to each other by strong connections which delimit a confinement zone for the hydrophilic powder in the casing. Advantageously, the lower and upper layers are connected to each other by first weak connections. The first weak connections delimit a plurality of adjacent cells in the confinement zone, each cell enclosing a quantity of hydrophilic powder sufficient to bring about the breakage of the first weak connections which delimit the cell when the hydrophilic powder absorbs a liquid.

20 Claims, 9 Drawing Sheets

(56) References Cited

U.S. PATENT DOCUMENTS

| | | | | |
|---|---|---|---|---|
| 2002/0081153 | A1* | 6/2002 | Genzel | E02B 3/108 405/114 |
| 2007/0125568 | A1* | 6/2007 | Kida | E02B 3/108 174/77 R |
| 2008/0250916 | A1* | 10/2008 | Bailey | F42D 5/045 89/36.02 |
| 2011/0297575 | A1* | 12/2011 | Bouchard | E02B 3/108 206/524.3 |
| 2012/0257928 | A1* | 10/2012 | Bailey | F42D 5/045 405/114 |

FOREIGN PATENT DOCUMENTS

| | | | | |
|---|---|---|---|---|
| FR | 2 559 158 | | 8/1985 | |
| JP | 3363273 | | 1/2003 | |
| JP | 2015-194053 | | 11/2015 | |
| KR | 0177842 | B1 * | 4/1994 | |
| NL | 8105097 | A * | 6/1983 | E02B 3/126 |

OTHER PUBLICATIONS

Written Opinion of the ISA for PCT/EP2020/058496 dated May 29, 2020, 6 pages.

* cited by examiner

DEVICE FOR ABSORBING A LIQUID PRESENT ON A FLOOR IN THE EVENT OF WATER-RELATED DAMAGE OR A FLOOD

This application is the U.S. national phase of International Application No. PCT/EP2020/058496 filed Mar. 26, 2020 which designated the U.S. and claims priority to FR Patent Application No. 1903160 filed Mar. 26, 2019, the entire contents of each of which are hereby incorporated by reference.

BACKGROUND OF THE INVENTION

Field of the Invention

The present invention relates to a device for absorbing a liquid present on a floor, in the event of a water damage or flood, for example. The invention also relates to a barrier for retaining water in the event of a water damage or flood, comprising several absorption devices.

Description of the Related Art

When a flood occurs, it is known to use sand bags to contain the flood water and sludge. For that purpose, the bags and the sand are transported separately on site, and then the bags are filled and positioned manually. The filling of the bags and their stacking are time-consuming tedious tasks. This solution is hence not adapted to fight against flash floods, or for people who are not used to physical effort.

An alternative solution consists in replacing the bags by water-permeable envelopes and the sand by a hydrophilic powder. In contact with water, the powder absorbs a certain quantity of water until becoming impervious. Once filled with water, the envelope is then capable of containing or diverting a flood.

Replacing the sand by a hydrophilic powder advantageously makes it possible to reduce the envelope volume. It is then easier to store the envelope in flood-risk areas, so as to allow a rapid use in case of flash flood. According to another advantage, for a similar efficiency, the quantity of hydrophilic powder contained in an envelope is far lower than the quantity of sand contained in a bag. That way, more people are able to move an envelope containing a hydrophilic powder than a bag containing sand. Particular reference will be made to U.S. Pat. No. 4,650,368, that proposes to use a bag containing a superabsorbent polymer.

Nevertheless, when handling the envelope, it turns out that the hydrophilic powder tends to accumulate in the corners and form agglomerates. In presence of a liquid, a watertight layer is formed about the center of each agglomerate. The hydrophilic powder present within these agglomerates is hence unused. This results in a variable and uncontrollable absorption capacity for each envelope. According to another drawback, when absorbing a liquid, the envelopes swell unevenly. The water-retaining barriers formed by stacking of this type of envelope hence comprise many infiltration routes between the envelopes, which hinders the efficiency of said barrier.

The invention aims to solve the above-mentioned problems, by proposing a device for absorbing a liquid present on a floor, in the event of a water damage or flood, comprising an envelope containing a hydrophilic powder allowing a greater absorption and a more homogeneous shape once soaked.

SUMMARY OF THE INVENTION

The invention proposes a device for absorbing a liquid present on a floor, in the event of a water damage or flood, comprising a hydrophilic powder contained in a liquid-permeable envelope, wherein the envelope is composed of an upper layer superimposed to a lower layer, the lower and upper layers being connected to each other by strong bonds, which strong bonds delimiting a containment area for the hydrophilic powder in the envelope.

The invention is wherein the lower and upper layers are connected to each other through first weak bonds, which first weak bonds delimiting several adjacent cells in the containment area, each cell hence enclosing a sufficient quantity of powder to cause the break of the first weak bonds delimiting the cell, when the powder absorbs a liquid.

The first weak bonds are arranged in such a way as to prevent the passage of the hydrophilic powder from one cell to another one. Hence, the quantity of powder liable to agglomerate in a part of the containment area is strongly limited. In other words, the presence of the cells makes it possible to limit the maximum size of the powder agglomerates in the containment area, and hence significantly increase the capacity as well as the rapidity of absorption of a liquid by the hydrophilic powder.

According to another feature of the invention, each cell encloses a quantity of hydrophilic powder adapted to absorb a sufficient volume of liquid to exert a pressure on the walls of the cell until causing a break of the first weak bonds. It is to be noted that the first weak bonds are configured in such a way as to give way before the lower layer or the upper layer is pierced or torn when the hydrophilic powder swells. This feature advantageously makes it possible to locally control the shape of the envelope when it is in contact with a liquid element. As their name indicates, strong bonds are more resistant to traction forces than weak bonds. In other words, the weak bonds are configured in such a way as to give way before the strong bonds.

According to another advantage, the strong bonds are configured to give way after the weak bonds, in order to prevent the dissemination of hydrophilic powder into the environment when the weak bonds are broken. In other words, the strong bonds delimit a containment area in which the hydrophilic powder is present, between the upper layer and the lower layer of the envelope, when the weak bonds are broken.

According to another feature of the invention, in the containment area, the smaller surface area delimited by a cell is equal to or higher than 5 $cm^2$, preferably equal to or higher than 10 $cm^2$.

According to another feature of the invention, the surface area of the containment area is equal to or higher than 80 $cm^2$, preferably equal to or higher than 1000 $cm^2$, preferably equal to or higher than 2000 $cm^2$.

According to another feature of the invention, once soaked with a liquid, the containment area is characterized by a height equal to or higher than 4 cm, preferably equal to or higher than 5 cm, advantageously higher than 6 cm. By "height", it is meant a dimension of the absorption device along a direction normal or substantially normal to the lower layer. The height of the absorption device is measured when said device is not covered by any other element. The height of the containment area is preferably measured at the center thereof.

According to another feature of the invention, the volume density of hydrophilic powder is identical or substantially identical in each cell present in the containment cell. This embodiment advantageously allows the envelope to have, after absorption of a liquid, a homogeneous or substantially homogeneous shape at the center of the containment area. That way, a stack of several protection devices according to the invention, after absorption of a liquid, is more stable with respect to the state of the art. A stronger watertight barrier can hence be made with a more limited number of envelopes.

According to another feature of the invention, the quantity of hydrophilic powder contained in the containment area is adapted in such a way that, once soaked with water, the envelope has a weight between 0.1 kg and 30 kg, preferably between 0.5 kg and 25 kg.

According to another feature of the invention, the hydrophilic powder comprises a water-retaining polymer, of natural or synthetic origin, having a water retention capacity higher than or equal to 30 times its weight in demineralized water, preferably higher than or equal to 50 times, advantageously higher than or equal to 100 times.

According to another feature of the invention, the upper layer includes at least one ease pleat, at the containment area, the ease pleat base being held through second weak bonds. By "pleat base", it is meant the area in which the upper layer is superimposed to itself in such a way as to locally form a double thickness. According to a preferred embodiment, the inside of the ease pleat includes a quantity of hydrophilic powder that is insufficient to cause, after absorption of a liquid, the break of the second weak bonds. Preferably, the inside of the ease pleat does not contain hydrophilic powder. The second weak bonds are arranged in such a way as to prevent the passage of the hydrophilic powder. According to a preferred embodiment, the upper layer includes at least two ease pleats, at the containment area. The ease pleats run along opposite edges of the containment area. This embodiment allows a more homogeneous unfolding of the upper layer between said edges, when the second weak bonds give way due to the swelling of the powder during the absorption of a liquid. This embodiment is particularly advantageous when the containment area is rectangular in shape and when it is desired to stack identical absorption devices according to the invention, to form barriers to retain a liquid in case of flood or water damage.

According to another feature of the invention, the ease pleat is configured to unfold in such a way as to avoid a tear of the lower layer and/or the upper layer, when the powder contained in the containment area absorbs a liquid. This embodiment advantageously makes it possible to increase the quantity of hydrophilic powder in one or several cells comprising the ease pleat, while avoiding a tear of the lower and/or upper layer when the envelope absorbs a liquid. In other words, for a containment area of same size, the ease pleat advantageously makes it possible to increase the quantity of hydrophilic powder contained in the containment area, and hence the water retention capacity of the envelope.

According to another feature of the invention, the ease pleat is configured in such a way as to maintain the flatness of the lower layer, when the hydrophilic powder contained in the containment area has absorbed a maximum quantity of liquid. In other words, the ease pleat is configured in such a way as to preferentially favor the unfolding of the upper layer towards the height of the absorption device, when the dehydrated powder absorbs a liquid. This embodiment advantageously makes it possible to maintain a greater surface area of contact between the lower layer of the envelope and a flat or substantially flat floor, in order to more efficiently retain or divert a liquid spreading on the floor.

According to another feature of the invention, the apex of the ease pleat is parallel or substantially parallel to an edge of the containment area. Preferably, at least one ease pleat extends all along an edge of the containment area.

According to another feature of the invention, the ease pleat is held against the upper layer, using third weak bonds located in the containment area.

According to another feature of the invention, the weak bonds are made by an ultrasonic welding technique.

The weak bonds are characterized by a far lower tear resistance with respect to the strong bonds. According to the invention, the weak bonds are configured in such a way as to give way in order not to break or tear the upper layer and/or the lower layer.

The invention also relates to a method for manufacturing a device for absorbing a liquid present of a floor, in the event of a water damage or flood, implementing the following steps:

- depositing a hydrophilic powder on a liquid-permeable lower layer;
- covering the hydrophilic layer with a liquid-permeable upper layer;
- making strong bonds between the lower layer and the upper layer, in such a way as to delimit a containment area for the hydrophilic powder between said layers;
- making weak bonds between the lower layer and the upper layer, in such a way as to confine the hydrophilic powder within separate and adjacent cells.

It is to be noted that the last two steps can be ease or made simultaneously.

The invention also relates to a method for manufacturing a device for absorbing a liquid present of a floor, in the event of a water damage or flood, implementing the following steps:

a) forming an ease pleat on a liquid-permeable upper layer; then
b) making weak bonds to maintain the ease pleat; then
c) positioning the upper layer against a liquid-permeable lower layer; then
d) making strong bonds between the upper layer and the lower layer, the strong bonds being arranged in such a way as to delimit a central edge and two lateral edges adjacent to the central edge, the ease pleat being present between the lateral edges;
e) making weak bonds between the upper layer and the lower layer, in such a way as to delimit adjacent pockets in the containment area; then
f) inserting a quantity of hydrophilic powder in each pocket; then
g) making weak bonds between the upper layer and the lower layer, in such a way as to close each pocket in order to obtain adjacent cells each containing a quantity of hydrophilic powder;
h) making strong bonds between the upper layer and the lower layer, in order to close the containment area.

According to an alternative embodiment, the steps g) and h) can be replaced by a step consisting in making only strong bonds between the upper layer and the lower layer, in such a way as to close simultaneously each pocket as well as the containment area. In other words, the strong bonds are arranged in such a way as to replace the weak bonds delimiting the peripheral edges of all the adjacent cells comprising hydrophilic powder.

According to an alternative embodiment, between the steps f) and g), the following steps can be implemented, in order to increase the number of adjacent cells present in the containment area:

1) making weak bonds between the upper layer and the lower layer, in such a way as to close each pocket in order to obtain adjacent cells each containing a quantity of hydrophilic powder;

2) making strong bonds between the upper layer and the lower layer, in such a way as to extend the lateral edges of the containment area;
3) making weak bonds in such a way as to delimit new adjacent pockets in the containment area, the bottom of each new pocket being delimited by at least one edge of a cell;
4) inserting a quantity of hydrophilic powder in each new pocket.

It is to be noted that steps 1) to 4) can be reproduced several times in a row, before the implementation of step h), in order to form an envelope containing several lines of adjacent cells.

The weak and strong bonds can be made according to at least one of the following techniques: bonding, sewing, welding or other.

According to an alternative embodiment of a manufacturing method described hereinabove, the weak bonds are made by an ultrasonic welding technique. The strong bonds can also be made by an ultrasonic welding technique.

The invention also relates to a water-retaining barrier in the event of a water damage or flood, comprising several absorption devices as described hereinabove.

BRIEF DESCRIPTION OF THE DRAWINGS

The following description in relation with the appended drawings, given by way of non-limitative examples, will allow a good understanding of what the invention consists of and of how it can be implemented.

DESCRIPTION OF THE PREFERRED EMBODIMENTS

As a reminder, the invention proposes a device for absorbing a liquid present on a floor, in the event of a water damage or flood, comprising an envelope containing a hydrophilic powder allowing a greater absorption of a liquid and of more homogeneous shape once soaked.

Figure 1:
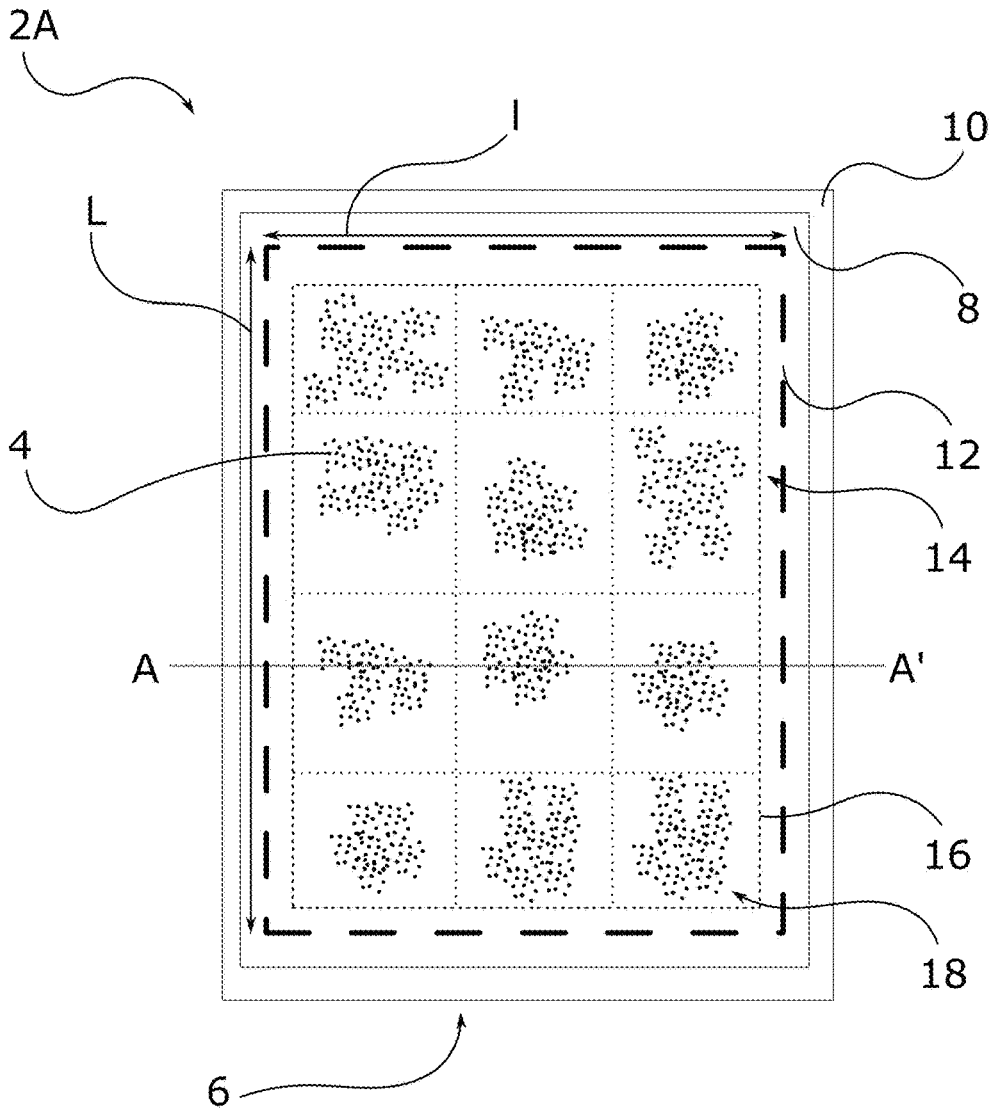
FIG. 1 illustrates a top view of a first example of an absorption device for flood according to the invention.
Figure 2:
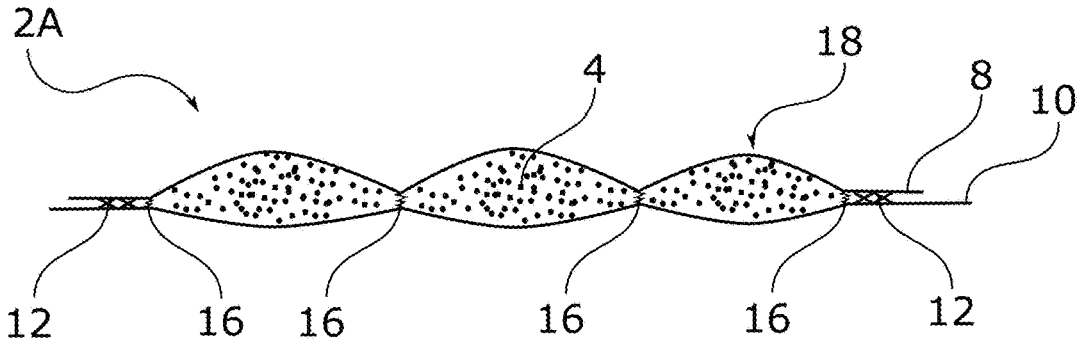
FIG. 2 illustrates a cross-sectional view along axis AA' of the absorption device shown in FIG. 1.
Figure 3:
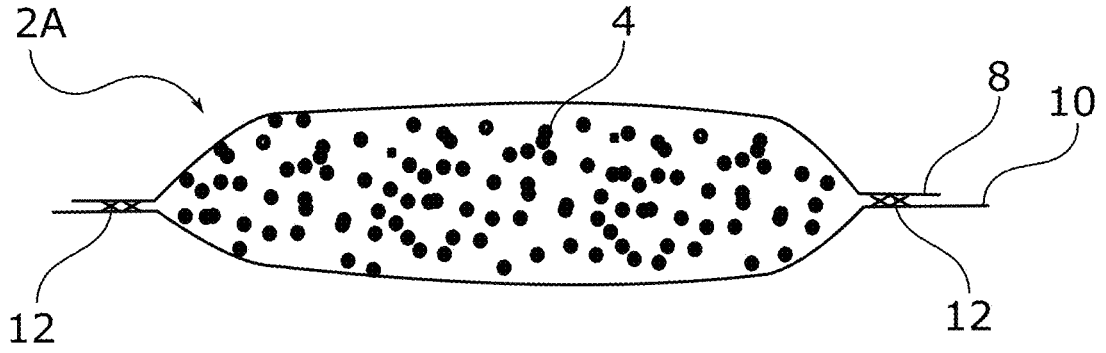
FIG. 3 illustrates a cross-sectional view along axis AA' of the absorption device shown in FIG. 1, after absorption of a liquid by said device.

FIGS. 1 to 3 illustrate a first embodiment of an absorption device 2A according to the invention. The absorption device includes a hydrophilic powder 4 confined in an envelope 6 that is permeable to a liquid, preferably water.

The hydrophilic powder 4 is composed of an absorbent material, made from a water-retaining polymer, of natural or synthetic origin. This type of polymer is generally known as SAP (for "superabsorbent polymer"). It is generally in the form of a powder, agglomerated or not. Their structure based on a three-dimensional network, comparable to a multitude of small cavities each having the capacity to deform and to absorb water, gives them the property of absorbing very great quantities of water and hence the property of swelling. By way of non-limitative examples, the hydrophilic powder is made from guar gum, alginate, carboxymethyl cellulose, dextran, xanthan gum . . . . The SAPs of synthetic origin usable within the framework of the present invention are for example cross-linked, or cross-linkable, water-soluble polymers. There exist many types of them. Such polymers are for example described in patent FR 2559158 in which are described cross-linked polymers of acrylic or methacrylic acid, cross-linked graft copolymers of the polysaccharide/acrylic or methacrylic acid type, cross-linked terpolymers of the acrylic or methacrylic acid/acrylamide/sulfonated acrylamide type and their alkaline earth or alkali metal salts. In a preferred embodiment, the monomers used for preparing superabsorbent polymers are chosen among acrylamide and/or partially or fully salified acrylic acid and/or partially or fully salified ATBS (acrylamido tertio butyl sulfonate) and/or NVP (N-vinylpyrrolidone) and/or acryloylmorpholine and/or partially or fully salified itaconic acid. In a preferred embodiment, the superabsorbent polymers are cross-linked homopolymers or copolymers based on partially or fully salified acrylic acid. Other hydrophilic monomers, for example cationic monomers, but also hydrophobic monomers, can be used to produce the superabsorbent polymers. Examples of cationic monomers include diallyldialkyl ammonium salts and the monomers of the dialkylaminoalkyl (meth)acrylate, dialkylaminoalkyl (meth)acrylamide type, as well as their quaternary ammonium or acid salts. Particular reference will be made to quaternized or salified dymethylaminoethyl acrylate (DMAEA) and/or dymethylaminoethyl methacrylate (DMAEMA), acrylamidopropyltrimethylammonium chloride (APTAC) and/or methacrylamidopropyltrimethylammonium chloride (MAPTAC). The synthetic superabsorbent polymers are generally cross-linked with 100 to 6000 ppm (parts per million) of at least one cross-linking agent chosen in the group comprising acrylic compounds, for example methylene-bis-acrylamide, allylic compounds, for example tetraallylammonium chloride, vinylic compounds, for example divinylbenzene, diepoxy, metal salts . . . . Some of them can also have a double cross-linking, for example by an acrylic cross-linking agent. The superabsorbent polymers can also be post-treated by a post-cross-linking of the surface of the polymer particles, in order to increase their capacity of absorption under the effect of pressure.

For cost reasons, superabsorbent polymers of synthetic origin of the cross-linked sodium polyacrylate type, with or without post-cross-linking, will be preferred. The SAP can be obtained by all the polymerization techniques well known by the person skilled in the art: gel polymerization, precipitation polymerization, emulsion polymerization (aqueous or ease) followed or not by a step of distillation, suspension polymerization, solution polymerization, such polymerizations being followed or not by a step allowing a dry form of co(polymer) to be isolated by any type of means well known by the person skilled in the art. The absorbent materials mentioned hereinabove can also be combined to each other to form hydrophilic powders of different compositions.

It has been surprisingly observed that, when the quantity of superabsorbent polymer used is overdosed with respect to what is required (due to its power of absorption), the absorbent article has a dry touch and no water release despite an increased risk of "gel blocking" phenomenon due to the presence of the cells.

The particle-size of the hydrophilic powder 4 confined in the envelope 6 is between 0.01 mm and 4 mm, preferably between 0.1 mm and 1 mm. The hydrophilic powder 4 is characterized by a water retention capacity higher than or equal to 30 times, preferably higher than or equal to 50 times, advantageously higher than or equal to 100 times, its weight in demineralized water.

According to a first embodiment illustrated in FIGS. 1 to 3, the hydrophilic powder 4 is present in an envelope 6 of the absorption device 2A. The envelope 6 is composed of an upper layer 8 superimposed to the lower layer 10. At least one of said layers is permeable to a liquid, preferably water, to allow the hydrophilic powder 4 to absorb said liquid. Preferably, the upper and lower layers are both permeable to a liquid. The upper layer 8 is a non-woven material. By "non-woven material", it is means a manufactured product, consisted of a web, sheet or mattress of fibers distributed directionally or randomly, having an internal cohesion, except weaving or knitting. The fibers of the upper layer 8 may be of synthetic and/or natural nature. According to the present example, the upper layer 8 is made from a hot-melt material based on polypropylene. The fibers of the upper layer 8 are arranged in such a way as to prevent the passage of the hydrophilic powder. The fibers form a mattress whose thickness is between 0.1 mm and 5 mm, preferably between 0.5 mm and 2 mm.

According to the present example, the lower layer 10 is identical or similar to the upper layer 8. It is to be noted that the lower and upper layers can be of different nature, potentially one of said layers can be partially or fully impermeable to a liquid.

The envelope 6 is made by holding the upper layer 8 against the lower layer 10, by means of strong bonds 12. The strong bonds 12 are arranged in such a way as to delimit, between said layers, a containment area 14 of the hydrophilic powder 4. The strong bonds 12 are adapted to retain the hydrophilic powder 4, in the containment area 14, after absorption of a liquid. The containment area can have various shapes as for example oval, polygonal or other. At the upper layer 8, the strong bonds 12 delimit a surface area equal to or greater than 80 $cm^2$, preferably equal to or greater than 1000 $cm^2$.

According to the present example, the strong bonds 12 delimit an area of rectangular shape at the upper layer 8, whose width I and length L are respectively between 200 mm and 600 mm, and between 400 mm and 1 000 mm.

According to another feature of the invention, the upper and lower layers are also held together through first weak bonds 16. As their name indicates, the first weak bonds are different from the strong bonds 12 in that they are more fragile. Indeed, the first weak bonds 16 are configured to give way when the hydrophilic powder absorbs a liquid, in order to preserve the integrity of the upper layer and/or the lower layer. Which is not the case of the strong bonds 12.

According to the present example, the strong and weak bonds are formed by welding to each other the upper and lower layers by an ultrasonic welding technique, so as to interlace the fibers composing said layers. Adhesives can also be used to form the bonds between the upper and lower layers. According to an alternative embodiment, the bonds can be made using a source of heat for locally fusing the fibers of the upper layer to the fibers of the lower layer. According to another embodiment, the upper layer can be pressed against the lower layer, in such a way as to locally interlace their fibers. The weak and strong bonds can hence be made from one or several techniques mentioned hereinabove, in such a way that the fibers belonging to the upper and lower layers are connected to each other at the bond, the identity of the individual fibers being not perceptible in the bond.

The first weak bonds 16 are arranged in such a way as to delimit adjacent cells 18 that are present in the containment area 14. The shape of the adjacent cells can be varied, such as, for example, oval, polygonal, or other. The first weak bonds 16 are made in such a way as, in particular, to prevent the passage of the hydrophilic powder from one cell to another one when the hydrophilic powder is dehydrated. At the upper layer 8, the surface area of a cell 18 is between 5 $cm^2$ and 600 $cm^2$, preferably between 14 $cm^2$ and 18 $cm^2$. By way of non-limitative example, the first weak bonds 16 can delimit rectangular cells whose sides are between 2 cm and 30 cm, preferably between 4 cm and 6 cm. The first weak bonds 16 can be arranged in such a way as to form a meshing of 12 cells, distributed over 3 columns and 4 lines as illustrated by FIG. 1. Of course, the number of cells, their shape as well as their arrangement can be changed according to the above-mentioned value ranges.

As illustrated in FIG. 2, each cell 18 encloses a quantity of dehydrated hydrophilic powder 4 between 0.04 $g/cm^2$ and 0.3 $g/cm^2$, preferably between 0.1 $g/cm^2$ and 0.2 $g/cm^2$. According to the present example, the basis weight of hydrophilic powder per cell is of the order of 3 g. The basis weight of hydrophilic powder and the number of cells 18 in the containment area 14, as well as the maximum volume of the containment area, are chosen in such a way that, once soaked with liquid, the envelope can be handled by a person of average constitution. Preferably, the weight of the envelope once hydrated is between 0.1 kg and 30 kg, preferably between 1 kg and 25 kg.

Advantageously, the first weak bonds 16 delimit cells 18 making it possible to limit the phenomenon of aggregation of the hydrophilic powder 4 in the containment area 14. Indeed, the aggregates formed by the hydrophilic powder cannot exceed the quantity of powder contained in one cell 18. That way, with respect to the state of the art, for a same quantity of powder, the invention allows a higher absorption of liquid in a shorter period of time, as will be shown in the following examples.

All the comparative tests hereinafter were performed under strictly identical conditions using a non-woven material M1542, sold by the Freudenberg company. They were carried out according to the following protocol. First, the various absorbent articles were swelled to their maximum capacity for 30 minutes in a tank of tap water at 16° C. Then, they have been taken out from the tank, and their homogeneity, or in other words the flatness of their upper face, has been evaluated. Nature of the polymers used, sold by the Aprotek company: Apromud G300: Sodium polyacrylate—100% anionic; Aprodev 03: Copolymer acrylamide-potassium acrylate—30% anionic.

TABLE 1

| | Volume in liters of the absorbent article/ (L × l × h) in dm | Superabsorbent polymer/quantity | Number of cells/Mass of SAP per cell | Homogeneity of the article after activation |
|---|---|---|---|---|
| Cex1 | 21.6/(6 × 4 × 0.9) | Apromud G300/ 288 g | None | Bad |
| Cex2 | 21.6/(6 × 4 × 0.9) | Aprodev 03/80 g | None | Bad |
| Ex1 | 21.6/(6 × 4 × 0.9) | Apromud G300/ 288 g | 96/3 g | Very good |
| Ex2 | 21.6/(6 × 4 × 0.9) | Aprodev 03/80 g | 40/2 g | Very good |
| Ex3 | 21.6/(6 × 4 × 0.9) | Apromud G300/ 288 g | 6/48 g | Very good |

The examples described in Table A (denoted Ex) show that the absorbent articles made according to the features of the invention exhibit a better homogeneity during their use, compared to the counter-examples (Cex), and that whatever the nature of the SAP used.

Unexpectedly, it has been found that absorbent articles that are particularly efficient, low bulk and very rapid to implement, can be obtained since the lower and upper layers are connected to each other through weak bonds, delimiting several adjacent cells in the containment area, each cell enclosing a sufficient quantity of superabsorbent hydrophilic powder to cause the break of the first weak bonds when it absorbs a liquid.

The absorbent articles according to the invention allow the humidity to very rapidly enter inside them and, once soaked with water, have an homogeneous shape ideal to form containment barriers, walls, dikes adapted to contain a liquid and without water release during their use.

The first weak bonds 16 are configured to give way when a quantity of hydrophilic powder, contained in an adjacent cell 18, absorbs a liquid and its volume increases. This feature makes it possible, on the one hand, to prevent a tear of the upper layer 8 and/or of the lower layer 10 when the hydrophilic powder swells, and on the other hand, to homogenize the thickness of the envelope 6 at the center of the containment area 14. Indeed, the first weak bonds 16 allow a more homogeneous distribution of the hydrophilic powder 4 in the containment area, and hence an also more homogeneous swelling of the envelope 6 when the latter is soaked with a liquid (see FIG. 3).

An envelope 6 according to the invention is characterized by a thickness between 1 mm and 50 mm, preferably between 2 mm and 20 mm, when the hydrophilic powder 4 is dehydrated. The thickness or the height of the envelope 6 is defined along a direction normal or substantially normal to the upper and lower layers. Its total weight is between 10 g and 500 g, preferably between 20 g and 400 g. The envelope 6 is hence light-weight and compact, easily transportable and storable in order to be used rapidly in case of flash flood. Once soaked with a liquid, the same envelope 6 has a thickness or height equal to or higher than 4 cm, preferably equal to or higher than 5 cm, advantageously higher than 6 cm.

An absorption device as described hereinabove can hence be used to absorb a liquid present on a floor, in the event of a water damage or flood, or as a drying mat or air duct plug, for example.

Potentially, a protection device according to the invention can include several dehydrated envelopes as described hereinabove, connected to each other by holding means, not shown. The holding means are preferably able to give way, in order to allow the use of one or several envelopes as a function of the task to be performed. By way of non-limitative example, several different envelopes can be made by superimposition of an upper layer to an lower layer, comprising perforations between each envelope 6, in order to facilitate their detachment from each other for a user to adjust the number of dehydrated envelopes as a function of the task to be performed. The length and width of such a strip of envelopes can be respectively between 1 m and 100 m, preferably between 5 m and 20 m, and between 0.5 and 4 m, preferably between 1 m and 2 m.

Figure 4:
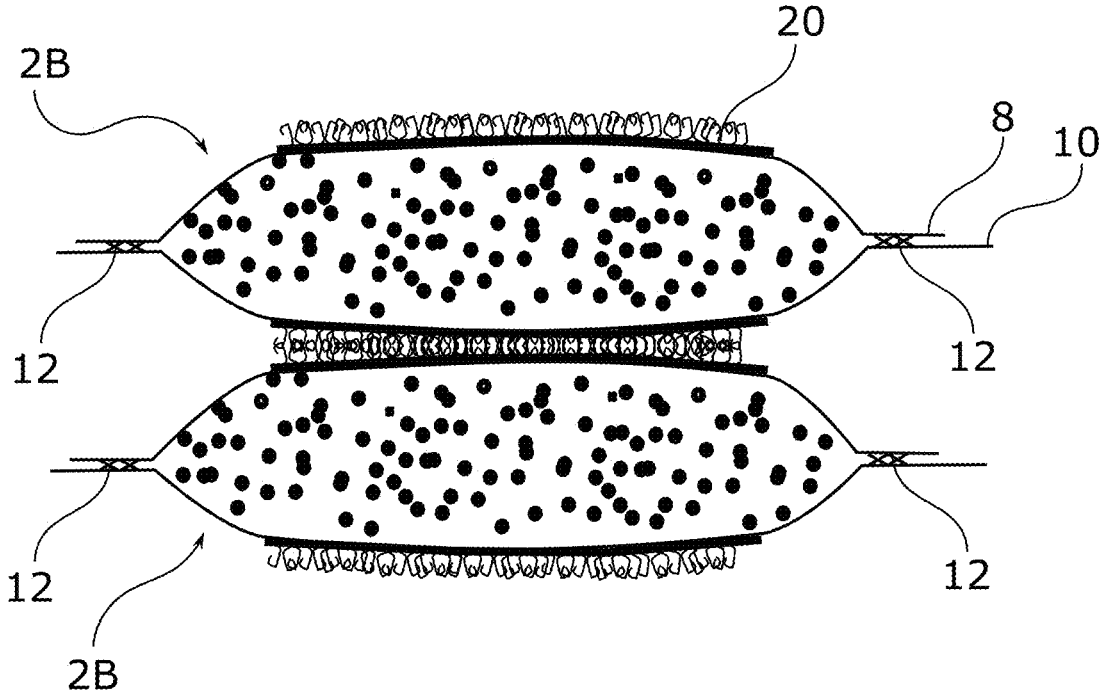
FIG. 4 illustrates a cross-sectional view of a second example of an absorption device according to the invention, showing two hydrated protection devices stacked on each other in such a way as to form an impervious barrier.

According to a second exemplary embodiment of an absorption device 2B according to the invention, the envelope 6 can include reversible holding means, configured to ensure a better holding between the envelopes when they are aligned with each other and/or superimposed to each other. It is to be noted that the identical or similar elements illustrated in the appended figures are indexed by the same numeral references. By way of example, the envelopes can include one or several adhesive strips arranged on their external surfaces, adapted to hook on the surface of another envelope. An envelope 6 can include a mechanical attachment system 20 comprising textile hooks and/or loops, adapted to cooperate with another mechanical attachment system, in order to ensure a better equilibrium of a stack of protection device 2 according to the invention as illustrated by FIG. 4.

Hence, several absorption devices can be assembled, through holding means, in such a way as to form a water-retaining barrier in the event of a water damage or flood.

Figure 5:
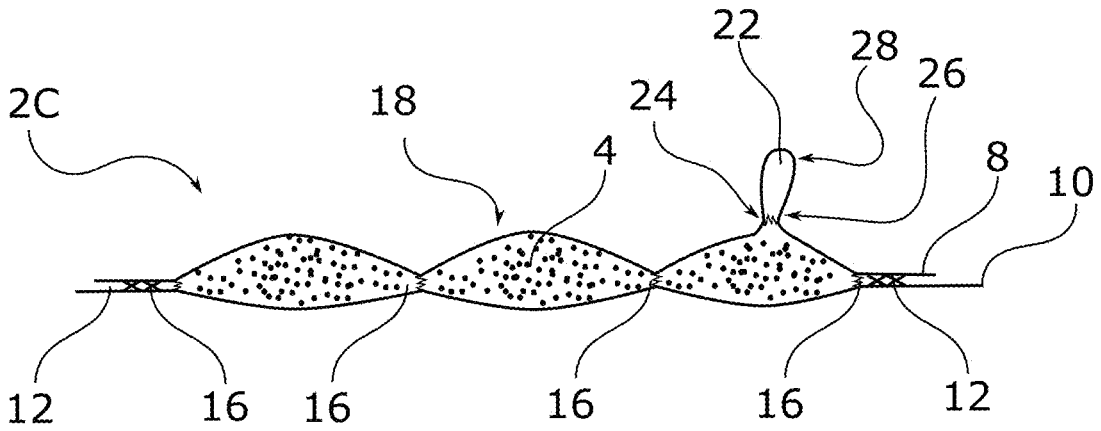
FIG. 5 illustrates a cross-sectional view of a third example of an absorption device according to the invention, comprising an ease pleat.
Figure 6:
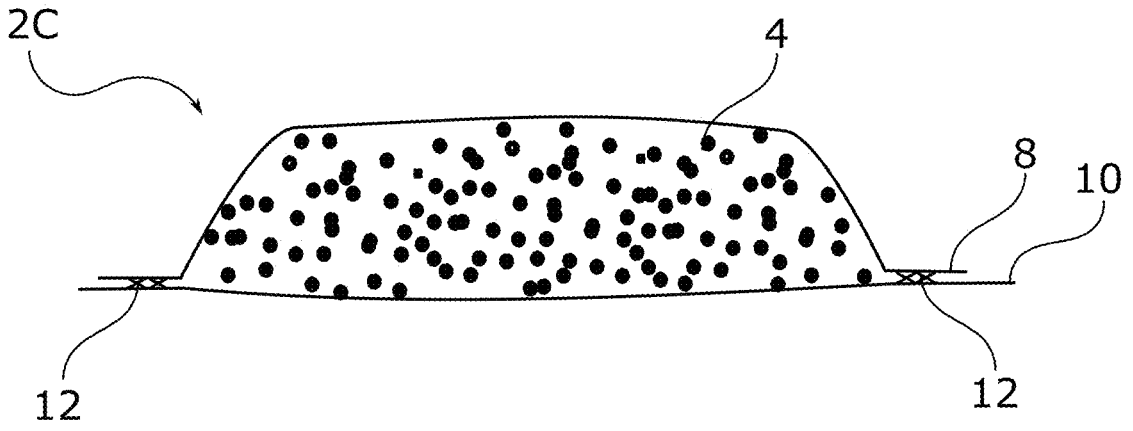
FIG. 6 illustrates a cross-sectional view of the third exemplary embodiment of the invention, after absorption of a liquid.

According to a third exemplary embodiment of an absorption device 2C according to the invention illustrated by FIGS. 5 and 6, the upper layer 8 of the envelope 6 includes a ease pleat 22. The ease pleat 22 is present at the containment area 14. The base 24 of ease pleat is held through second weak bonds 26. By "pleat base", it is meant an area in which the upper layer 8 is superimposed to itself and locally form a double thickness. The inside of the ease pleat 22 includes an insufficient quantity of hydrophilic powder to cause the break of the second weak bonds 26 after absorption of a liquid. Preferably, the inside of the ease pleat 22 does not contain hydrophilic powder. The second weak bonds 26 are arranged in such a way as to prevent the hydrophilic powder 4 from entering the ease pleat 22. After breaking of the second weak bonds 26, the ease pleat 22 is configured to unfold in such a way as to avoid a tear of the lower layer and/or the upper layer, when the powder contained in the containment area absorbs a liquid. According to a preferred embodiment and as illustrated in FIG. 6, the ease pleat 22 is configured in such a way as to maintain the flatness of the lower layer 10 of the envelope, when the hydrophilic powder contained in the containment area is totally hydrated. This embodiment advantageously allows increasing the surface area of contact between the lower layer 10 of the envelope and a flat or substantially flat floor, in order to retain or divert more efficiently a liquid spreading on the floor. Preferably, the apex 28 of the ease pleat 22 is parallel or substantially parallel to an edge of the containment area 14.

Figure 7:
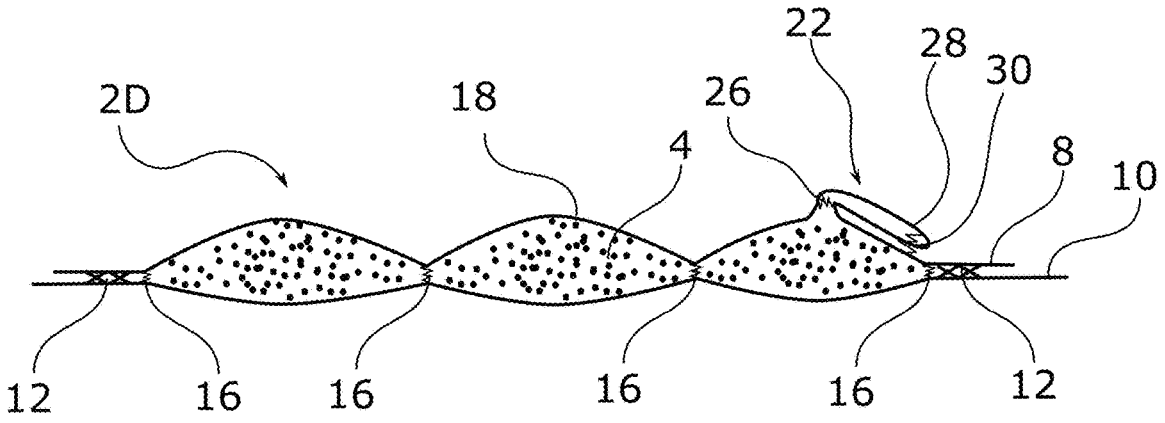
FIG. 7 illustrates a cross-sectional view of a fourth example of an absorption device according to the invention, comprising an ease pleat applied against said device.
Figure 8:
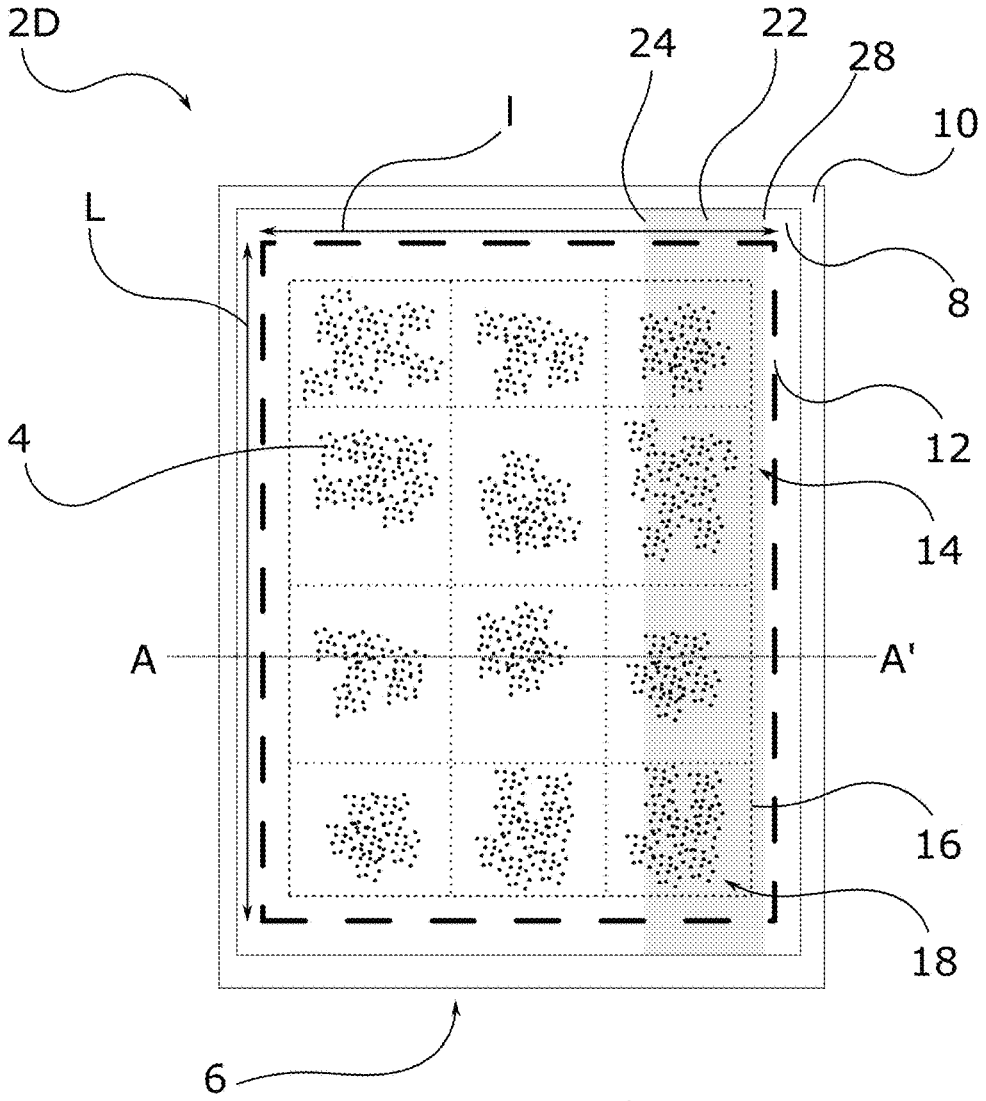
FIG. 8 illustrates a top view of an absorption device shown in FIG. 7.

According to a fourth exemplary embodiment of an absorption device 2D according to the invention illustrated in FIGS. 7 and 8, the ease pleat 22 is held against the upper layer 8, by means of third weak bonds 30. The third weak bonds have features identical or similar to the first and second weak bonds described hereinabove. The third weak bonds 30 are present outside, or preferably inside, the containment area 14.

Figure 9:
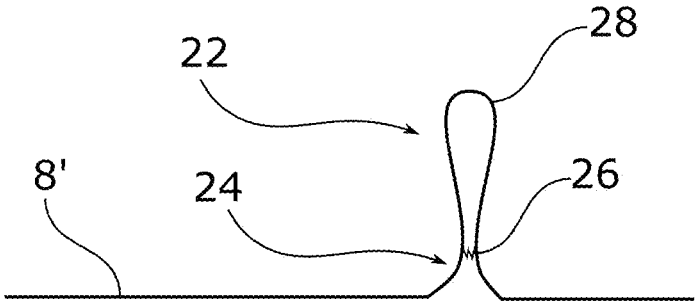
FIG. 9 to FIG. 17 illustrate the different steps of making an absorption device according to the invention.

The invention also relates to a method for manufacturing an absorption device against floods, as described hereinabove. The manufacturing method implements a first step illustrated in FIG. 9, consisting in making an ease pleat 22 on an upper strip 8'. The upper strip 8' is of a nature identical or similar to an upper layer 8 described hereinabove. Before the folding, the upper strip is characterized by a length between 1 m and 100 m, preferably between 5 m and 20 m. The ease pleat 22 has an apex 28 extending parallel or substantially parallel to the longitudinal direction of the upper strip 8'.

Figure 10:
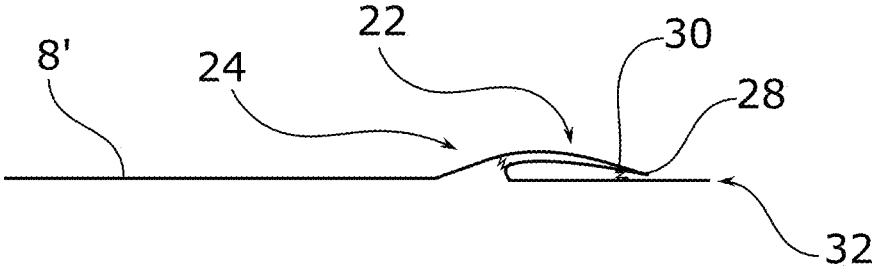

According to a second step illustrated by FIG. 10, the ease pleat 22 is applied against the upper strip 8' in such a way that its apex 28 is slightly set back from a longitudinal edge 32 of the upper strip 8'. At the ease pleat 22, the upper strip has hence a triple thickness. Third weak bonds 30 are made on the upper strip 8' in such a way as to hold the ease pleat against said strip.

Figure 11:
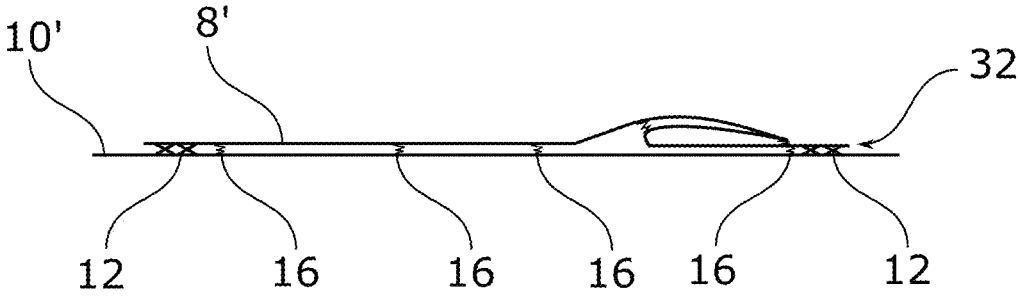

According to a third step illustrated in FIG. 11, the upper strip 8' is superimposed to a lower strip 10'. The lower strip 10' is of a nature and size identical or substantially identical to the upper strip 8'. Preferably, the ease pleat 22 is oriented towards the outside.

Figure 12:
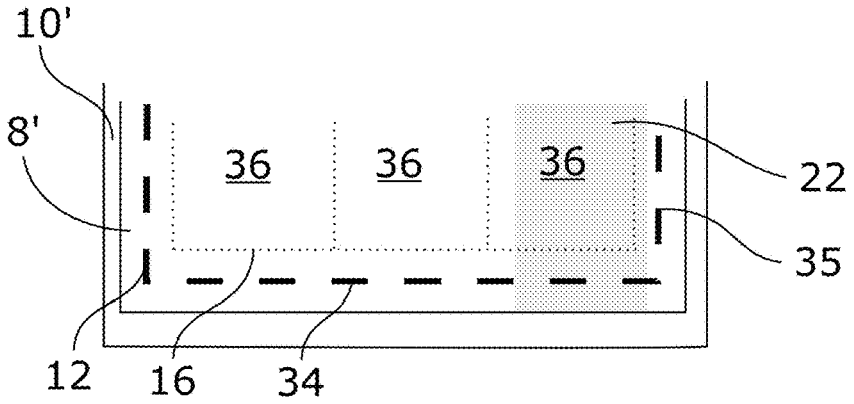

According to a fourth step illustrated in FIGS. 11 and 12, strong bonds 12 are made between the upper strip 8' and the lower strip 10'. A first series of strong bonds is made, along a direction perpendicular or substantially perpendicular to the longitudinal axis of the upper strip 8', in order to delimit a central edge 34 of the containment area 14 to be defined. A second series of strong bonds 12 is made, along a direction parallel or substantially parallel to the longitudinal axis of the upper strip 8', in order to delimit two opposite lateral edges 35 of the containment area 14.

According to a fifth step illustrated in FIG. 12, first weak bonds 16 are made between the upper strip 8' and the lower strip 10'. The first weak bonds 16 are arranged in such a way as to delimit adjacent pockets 36 in the containment area 14.

Figure 13:
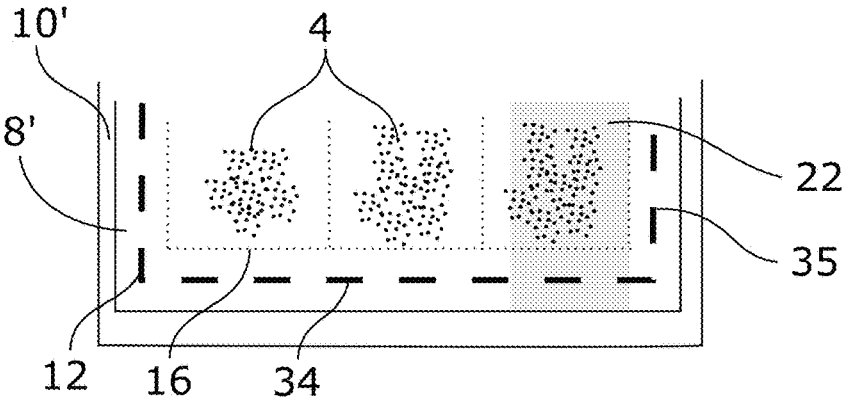

According to a sixth step illustrated in FIG. 13, dehydrated hydrophilic powder 4 is introduced into each pocket 36. The hydrophilic powder is of a nature identical or substantially identical to the examples mentioned hereinabove. The quantity of hydrophilic powder 4 introduced in each pocket 36 is chosen in such a way as to respect the above-mentioned value ranges.

Figure 14:
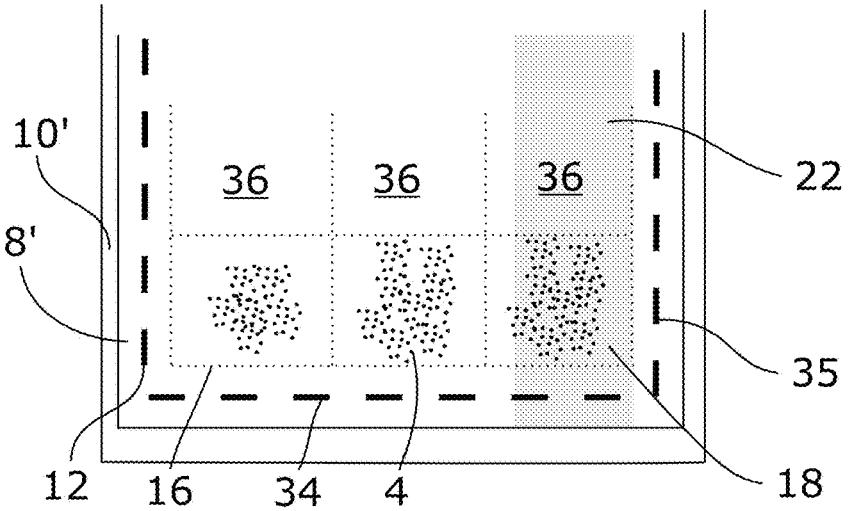

According to a seventh step illustrated in FIG. 14, first weak bonds 16 are made between the upper strip 8' and the lower strip 10', in order to close each pocket 36 in such a way as to enclose the hydrophilic powder 4 within several adjacent cells 18. According to the present example, the cells 18 are three in number. First weak bonds 16 are made between the upper strip 8' and the lower strip 10', in order to form other pockets 36 adjacent to the cells 18. Strong bonds are also made to extend the lateral edges 35 of the containment area.

Figure 15:
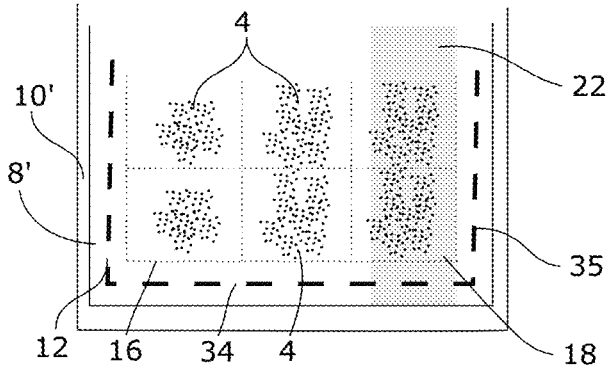

According to an eleventh step illustrated in FIG. 15, dehydrated hydrophilic powder 4 is introduced into each pocket 36.

Figure 16:
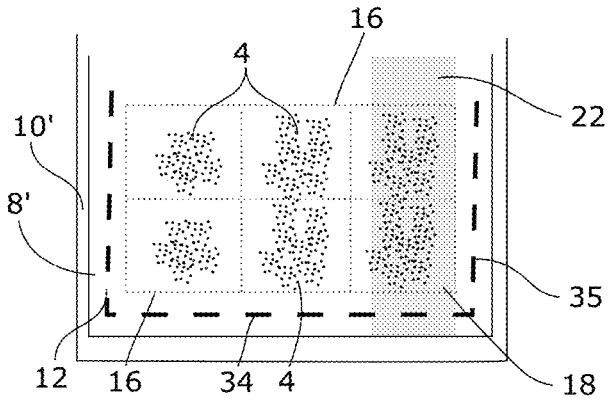

According to a twelfth step illustrated in FIG. 16, first weak bonds 16 are made between the upper strip 8' and the lower strip 10', in order to close each pocket 36 in such a way as to enclose the hydrophilic powder 4 in several adjacent cells 18.

Figure 17:
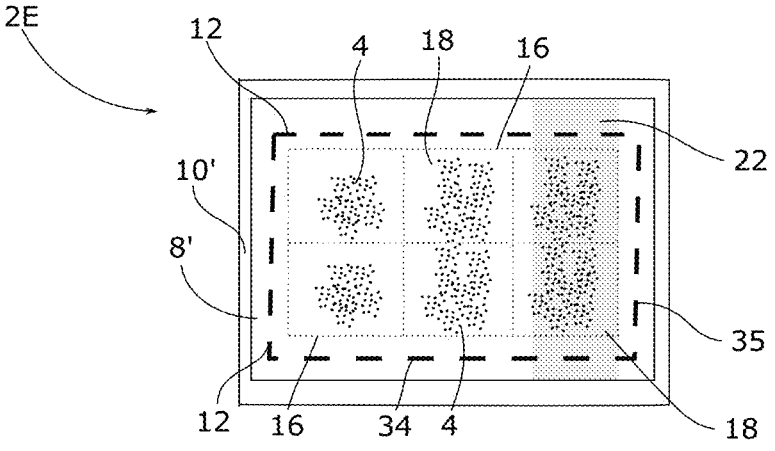

According to a thirteenth and last step illustrated in FIG. 17, strong bonds 12 are made between the upper strip 8' and the lower strip 10', in order to close the containment area 14. An absorption device 2E against floods as described hereabove is hence obtained. It is to be noted that the number as well as the arrangement of the cells 18 can be changed or varied at will.

Preferably, the links mentioned hereinabove are made by an ultrasonic welding technique.

Figure 18:
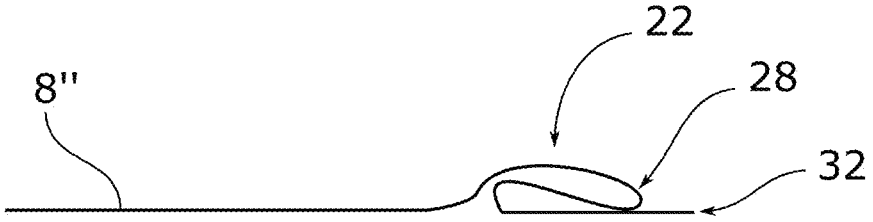
FIG. 18 to FIG. 21 illustrate the different steps of another embodiment of an absorption device according to the invention.

According to an alternative embodiment of a manufacturing method described hereinabove, the manufacturing method implements a first step illustrated in FIG. 18, consisting in making an ease pleat 22 on an upper strip 8" by means of not-shown guides. The upper strip 8" is of a nature identical or similar to an upper layer 8 described hereinabove. Before folding, the upper strip is characterized by a length between 1 m and 100 m, preferably between 5 m and 20 m. The ease pleat 22 has an apex 28 extending parallel or substantially parallel to the longitudinal direction of the upper strip 8". The ease pleat 22 is applied against the upper strip 8", in such a way that its apex 28 is slightly set back from a longitudinal edge 32 of the upper strip 8". At the ease pleat 22, the upper strip has hence a triple thickness.

Figure 19:
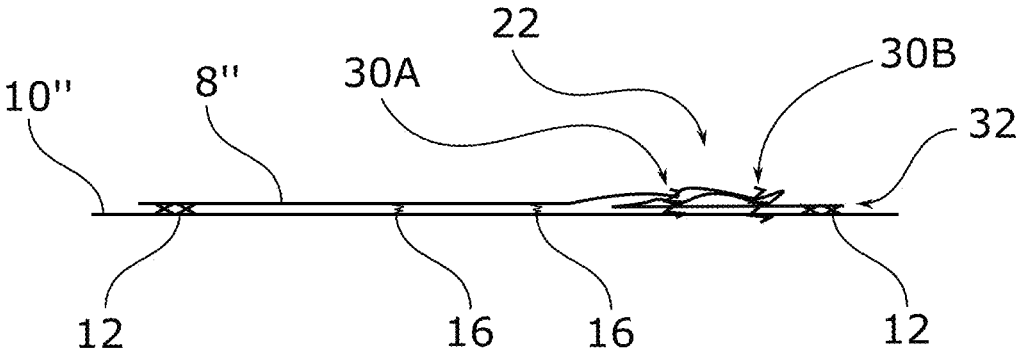

According to a second step illustrated by FIG. 19, the upper strip 8" is superimposed to a lower strip 10". The lower strip 10" is of a nature and size identical or substantially identical to the upper strip 8". Preferably, the ease pleat 22 is oriented towards the outside. Third weak bonds 30 are then made on the upper strip 8", in such a way as to hold the ease pleat against said strip. More precisely, third weak bonds 30A are made at the base of the pleat 22 and third weak bonds 30B are made at the apex 28 of the pleat. The weak bonds 30A and 30B make it possible to locally maintain a triple thickness of the layer 8". It is to be noted that the weak bonds 30A and 30B also locally maintain the lower layer 10".

According to a third step, strong bonds 12 and weak bonds 16 are made simultaneously between the upper strip 8' and the lower strip 10', in such a way as to delimit a part of the peripheral edges of a containment area to be made and pockets 36 contained in said area. It is to be noted that the strong bonds 12 delimit several edges of the containment area as well as several edges of the pockets 36. With respect to the above-mentioned embodiment, the present embodiment offers the advantage to limit the number of weak bonds to delimit the pockets 36. This hence represents time saving and thus economy of realization.

Figure 20:
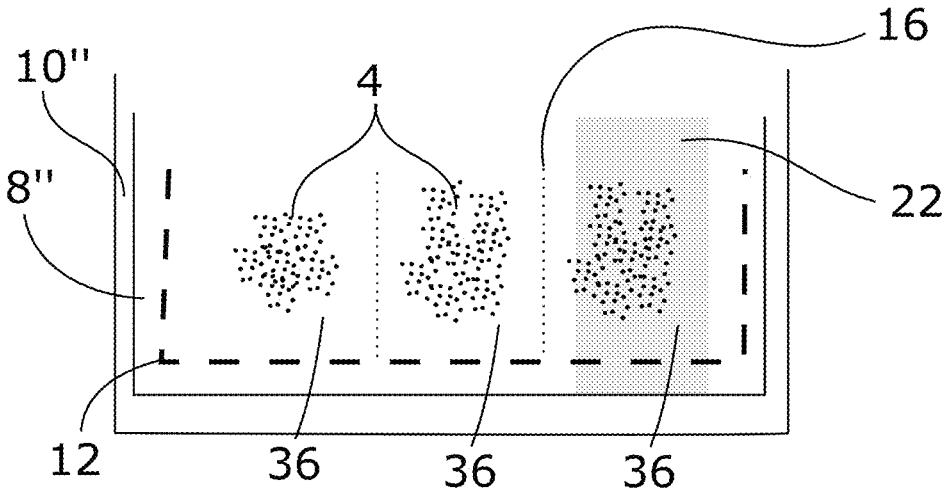

According to a fourth step illustrated in FIG. 20, dehydrated hydrophilic powder 4 is introduced in each pocket 36. The hydrophilic powder is of a nature identical or substantially identical to the above-mentioned examples. The quantity of hydrophilic powder 4 introduced in each pocket 36 is chosen in such a way as to respect to above-mentioned value ranges.

Figure 21:
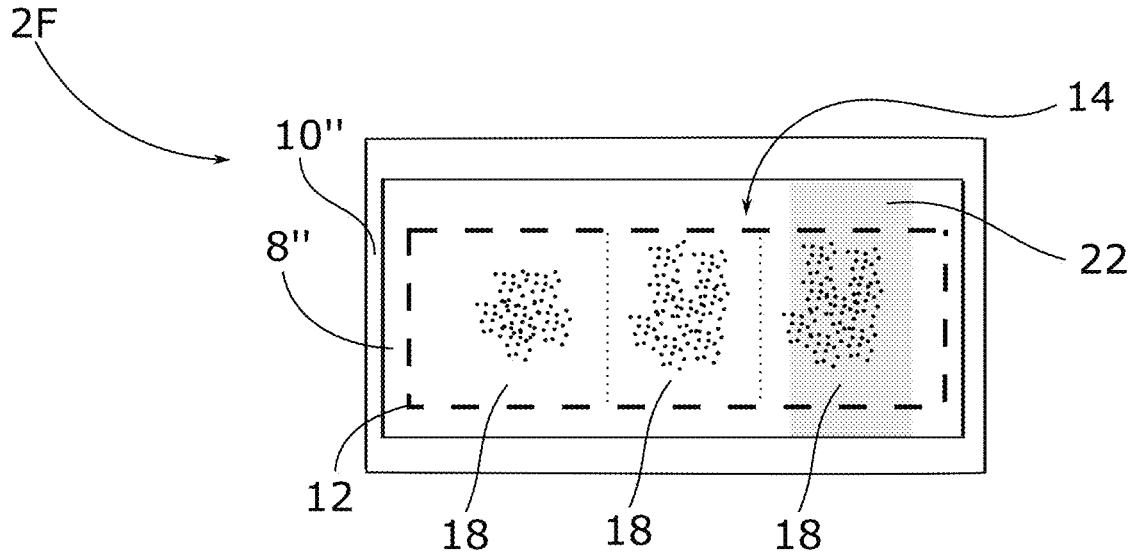
Figure 22:
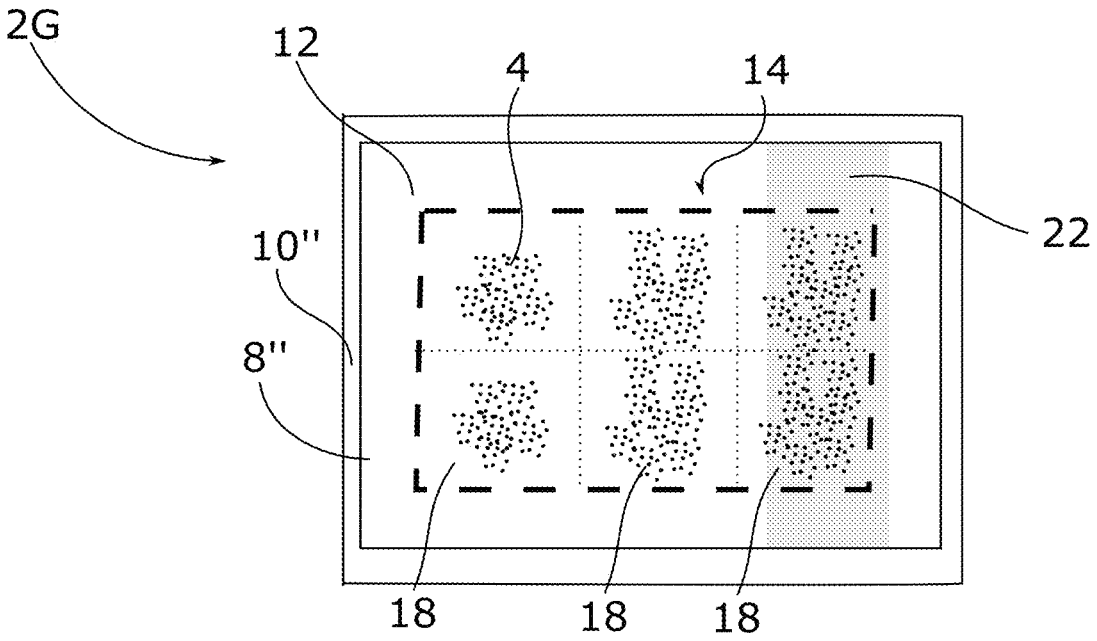
FIG. 22 illustrates a top view of an alternative embodiment of an absorption device according to the invention.

According to a fifth step illustrated in FIG. 21, strong bonds 12 are made to close simultaneously the containment area 14 and the pockets 36 containing the hydrophilic powder in order to form the above-mentioned cells 18. In other words, the absorption device 2F illustrated in FIG. 21 is different from the preceding one in that the weak bonds 16 are replaced by strong bonds 12 to delimit the peripheral edges of the group of pockets 36, in order to form a set of cells 18 according to the invention. It is to be noted that the number of cells 18 is not to limited to the present case. For example, an absorption device 2G can be obtained by implementing the above-mentioned method, in such a way as to obtain a higher number of cells 18 in the containment area 14, as illustrated by FIG. 22.

The invention claimed is:

1. An absorption device for absorbing a liquid present on a floor, in the event of a water damage or flood, comprising:

a liquid-permeable envelope comprised of an upper layer and a lower layer;

strong bonds that connect the lower layer to the upper layer, the strong bonds delimiting a containment area within the liquid-permeable envelope;

a hydrophilic powder contained with the containment area of the liquid-permeable envelope;

first weak bonds that connect the lower layer to the upper layer, the first weak bonds delimiting plural adjacent cells in the containment area delimited by the strong bonds, each cell enclosing a sufficient quantity of the hydrophilic powder to cause, when the hydrophilic powder absorbs a liquid, a break of the first weak bonds delimiting the cell, the break allowing the hydrophilic powder to escape from the cell, wherein the weak bonds are configured to give way and break before the strong bonds, and wherein the strong bonds retain the hydrophilic powder in the confinement area when the weak bonds give way and the hydrophilic powder escapes from the cells.

2. The absorption device according to claim 1, wherein the smallest surface area delimited by a cell is equal to or higher than 5 $cm^2$.

3. The absorption device according to claim 1, wherein the surface area of the containment area is equal to or higher than 80 $cm^2$.

4. The absorption device according to claim 1, wherein, once soaked with a liquid, the containment area has a height equal to or higher than 4 cm.

5. The absorption device according to claim 1, wherein the volume density of hydrophilic powder is identical or substantially identical in each cell.

6. The absorption device according to claim 1, wherein the quantity of hydrophilic powder contained in the containment area is adapted in such a way that, once soaked with water, the envelope has a weight between 0.1 kg and 30 kg.

7. The absorption device according to claim 1, wherein the hydrophilic powder comprises a water-retaining polymer, of natural or synthetic origin, having a water retention capacity higher than or equal to 30 times its weight in demineralized water.

8. The absorption device according to claim 1, wherein the upper layer includes at least one ease pleat, at the containment area, the base of the ease pleat being held through second weak bonds.

9. The absorption device according to claim 8, wherein the ease pleat is configured to unfold in such a way as to avoid a tear of the lower layer and/or the upper layer, when the powder contained in the containment area absorbs a liquid.

10. The absorption device according to claim 8, wherein the ease pleat is configured in such a way as to maintain the flatness of the lower layer when the hydrophilic layer contained in the containment area is totally hydrated.

11. The absorption device according to claim 8, wherein the ease pleat is held against the upper layer using third weak bonds located in the containment area.

12. The absorption device according to claim 1, wherein the weak bonds are made by an ultrasonic welding technique.

13. A method for manufacturing an absorption device according to claim 1, the method comprising:

depositing a hydrophilic powder on a liquid-permeable lower layer;

covering the hydrophilic layer with a liquid-permeable upper layer;

making strong bonds between the lower layer and the upper layer, in such a way as to delimit a containment area for the hydrophilic powder between said layers;

making weak bonds between the lower layer and the upper layer, in such a way as to confine the hydrophilic powder within separate and adjacent cells.

14. A method for manufacturing an absorption device according to claim 1, the method comprising:

a) forming an ease pleat on a liquid-permeable upper layer; then b) making weak bonds on the upper layer to maintain the ease pleat; then c) positioning the upper layer against a liquid-permeable lower layer; then d) making strong bonds between the upper layer and the lower layer, the strong bonds being arranged in such a way as to delimit a central edge and two lateral edges adjacent to the central edge, the ease pleat being present between the lateral edges; and e) making weak bonds between the upper layer and the lower layer, in such a way as to delimit adjacent pockets in the containment area; then f) inserting a quantity of hydrophilic powder in each pocket; then g) making weak bonds between the upper layer and the lower layer, in such a way as to close each pocket in order to obtain adjacent cells each containing a quantity of hydrophilic powder;

h) making strong bonds between the upper layer and the lower layer, in order to close the containment area.

15. The method for manufacturing an absorption device according to claim 14, wherein steps g) and h) are replaced by a step consisting in making only strong bonds between the upper layer and the lower layer, in such a way as to close simultaneously each pocket as well as the containment area.

16. The method for manufacturing an absorption device according to claim 13, wherein the weak bonds are made by an ultrasonic welding technique.

17. The absorption device of claim 3, wherein the surface area of the containment area is equal to or higher than 1,000 $cm^2$.

18. The absorption device of claim 4, wherein once soaked with a liquid, the containment area has a height equal to or higher than 5 cm.

19. The absorption device according to claim 6, wherein the quantity of hydrophilic powder contained in the containment area is adapted in such a way that, once soaked with water, the envelope has a weight between 0.5 kg and 25 kg.

20. The absorption device according to claim 2, wherein the surface area of the containment area is equal to or higher than 80 $cm^2$.

* * * * *